US005473312A

United States Patent [19]

Duran

[11] Patent Number: 5,473,312

[45] Date of Patent: Dec. 5, 1995

[54] FULL CONTAINER RECOGNITION SYSTEM

[76] Inventor: Lawrence Duran, 12800 Crows Cir., Anchorage, Ak. 99515-3728

[21] Appl. No.: 185,700

[22] Filed: Jan. 24, 1994

[51] Int. Cl.[6] ..... G08B 21/00

[52] U.S. Cl. ..... 340/612; 340/615; 250/223 R; 250/222.1; 250/221; 200/61.21; 200/61.2

[58] Field of Search ..... 340/612, 615; 250/221, 222.1, 223 R; 200/61.2, 61.21, 61.23, 61.24, 61.41, 61.42

[56] References Cited

U.S. PATENT DOCUMENTS

| | | | |
|---|---|---|---|
| 2,642,276 | 6/1953 | Monson | 265/51 |
| 3,421,594 | 1/1969 | Hino | 177/223 |
| 3,628,617 | 12/1971 | Ferrigan | 177/116 |
| 3,685,356 | 8/1972 | Zimmerman | 73/290 R |
| 4,074,507 | 2/1978 | Ruf et al. | 53/59 W |
| 4,495,388 | 1/1985 | Yoder | 200/61.21 |
| 4,519,506 | 5/1985 | Cornelis | 209/592 |
| 4,610,147 | 9/1986 | Kawasumi | 62/137 |
| 4,779,402 | 10/1988 | Duynhoven et al. | 53/529 |
| 4,928,473 | 5/1990 | Nagao et al. | 53/53 |

*Primary Examiner*—John K. Peng

*Assistant Examiner*—Julie B. Lieu

*Attorney, Agent, or Firm*—Christensen, O'Connor Johnson & Kindness

[57] ABSTRACT

Disclosed is a full container recognition system (5) for determining when a container (16) having an upwardly facing opening is filled with articles (18) to a predetermined level. The system includes at least one deflectable feeler arm (10) mounted to a support (22) so that an outer end (32) of the feeler arm extends over the opening of the container. As articles (18) are loaded into the container (16), the articles impact the outer end (32) of the feeler arm (10) causing the feeler arm to deflect downwardly from an up position in which the feeler arm is biased. When the article (18) passes downwardly beyond the outer end (32) of the feeler arm (10), the biasing arrangement causes the feeler arm to return to the up position. However, when the depth of articles (18) in the container (16) reaches the predetermined level, an article being loaded does not pass beyond the end of the feeler arm, causing the feeler arm (10) to remain in a deflected position and thereby indicating that the container has been filled to approximately the predetermined level. A sensor (72 and 74) and timer (76) determine when the feeler arm (10) has been deflected downwardly, but has not returned to the up position within a predetermined period of time.

20 Claims, 3 Drawing Sheets

20
68
76
10
18
22
26
10
12
16A
16
6A
5
6
8

FULL CONTAINER RECOGNITION SYSTEM

FIELD OF THE INVENTION

This invention relates to methods and apparatus for material handling during operations such as the shipping and receiving of various articles. More specifically, this invention relates to methods and apparatus for sensing when a container has been filled to a predetermined level.

BACKGROUND OF THE INVENTION

Numerous advances have been made with respect to material handling during manufacture, shipment, transport, and receiving of virtually all types of articles and material. However, one problem that has not been fully addressed is determining when a container, such as a bag, has been filled to a desired level. A need exists for such a system in numerous situations in which it is necessary to supply a signal that indicates when an operator or other equipment should begin filling the next container. The traditional approach to the foregoing problem has been simply to have a human operator monitor the filling or loading process, and when the container is full, activate a switch or perform some other action that causes the filling of another container.

Relying upon a human operator presents several disadvantages and drawbacks. First, human operators are expensive in terms of labor costs. Second, human operators sometimes become bored and inattentive with repetitive tasks, and hence may not provide the desired reliability. Third, human operators may not be able to "reliably" detect when a container is filled within a narrow tolerance level.

Some attempts have been made to construct sensing arrangements that eliminate the need for intense human observation. However, these devices have been directed to very specialized situations. Moreover, prior known devices are relatively expensive and often are not as reliable as desired.

In contrast, the present invention provides a solution to the foregoing problem in that it provides a sensing device that indicates when a container or enclosure is filled to a predetermined level, can be interfaced with automatic filling equipment, or signal to a human operator that the enclosure is full, and is simple, reliable, and inexpensive.

SUMMARY OF THE INVENTION

The present invention provides a full container recognition system for determining when a container is filled with articles to a predetermined level. The system, which is for use with containers having an upwardly facing opening, includes at least one deflectable feeler arm mounted to a support so that the outer end of the feeler arm extends over the opening of the container.

As articles are loaded into the container, the articles impact the outer end of the feeler arm causing the feeler arm to deflect downwardly from an up position to which the feeler arm is biased to return. When the container is only partially filled, an article being loaded passes downwardly beyond the outer end of the feeler arm, and the biasing causes the feeler arm and to return to the up position. However, if the depth of articles in the container is approximately equal to the predetermined level, the feeler arm remains in a deflected position, indicating that the container has been filled to approximately the predetermined level. A sensor and timer determines when the feeler arm has been deflected downwardly, but has not returned to the up position within a predetermined period of time.

Preferably, the system includes a plurality of substantially identical feeler arms extending from the support in a circumferential spaced apart relationship with one another. Each feeler arm is rotatably mounted to the support at a location between the feeler arm inner and outer ends. The biasing acts upon the inner end of the feeler arm, urging the inner end of the feeler arm downwardly.

An outer support ring of substantially circular cross-sectional geometry is provided as part of the support. Each feeler arm includes a cylindrical sleeve which coaxially surrounds the outer support ring, thereby rotatably mounting each feeler arm to the outer support ring. The currently preferred system also includes a stop ring, which is spaced-apart from and concentrically surrounded by the outer support ring. When a feeler arm is biased in the up position, the inner end of the feeler arm abuts the stop, thereby preventing further upward rotation of the feeler arm.

The present invention also provides a method for determining when a container is filled with articles to a predetermined level. The method is for use with containers having an upwardly facing opening, and includes positioning a feeler arm having an outer end in a first, upwardly biased position so that the outer end of the feeler arm extends over the opening. Articles are repeatedly loaded into the container along a path that causes the articles to contact the outer end of the feeler arm and deflect it downward from the first position.

The method further includes the step of detecting when the feeler arm has remained downwardly deflected from the first position for a period of time greater than a predetermined period. Fulfillment of the foregoing condition indicates that the container has been filled to approximately the predetermined level, at which point no additional articles are loaded into the container.

Preferably, the step of positioning the feeler arm includes two substeps. The first step is to rotatably mount the feeler arm to an axle, with the feeler arm rotatable to an up position and to a down position. The second step is to position the axle with the outer end of the feeler arm being biased in the up position and extending over the container opening.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
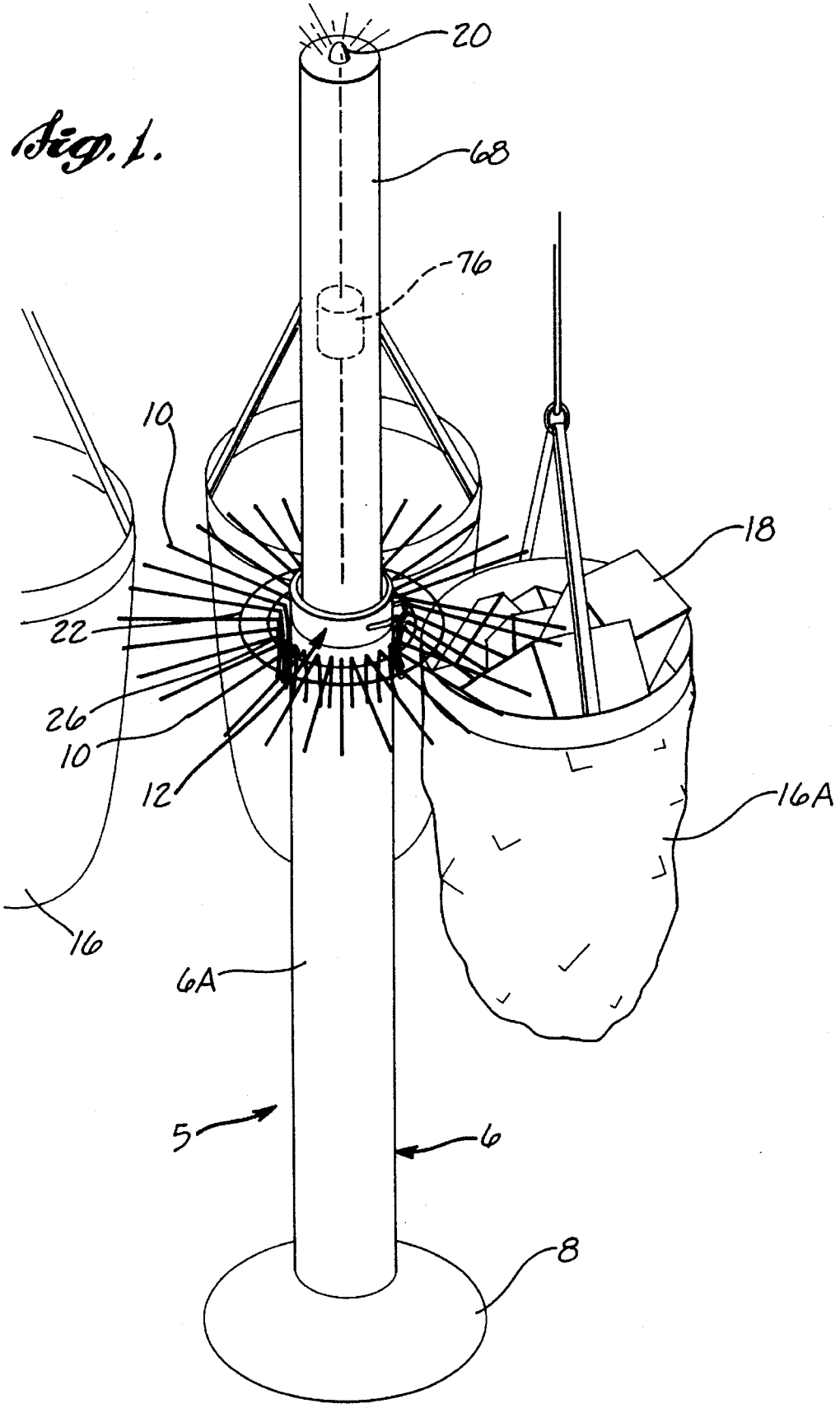
FIG. 1 is an isometric view of an arrangement that is constructed in accordance with the invention for detecting when bags have been filled to a desired level with loose articles such as packages.

Referring to FIG. 1, a preferred embodiment of a full container recognition system constructed in accordance with the present invention is indicated generally by reference numeral 5. The system 5 includes a post 6, vertically mounted in a stabilizing base 8. Concentrically surrounding the post 6 and spaced apart from the base 8 is a cylindrical collar assembly 12, which includes a plurality of circumferentially spaced-apart, radially extending feeler arms 10.

In the embodiment of FIG. 1, the full container system is configured for use in filling a series of bag-like containers 16 with various sized, box-like packages or articles 18. In this arrangement of the system, containers 16 are suspended by traps from a conveyance or support system (not shown in FIG. 1) so that a plurality of containers surround post 6. Upon understanding the invention, it will be recognized that various apparatus can be used for positioning and/or transporting containers that are used in practicing the invention. The important aspect of the container support arrangement being that the feeler arms 10 extend over a portion of the upwardly facing opening of the container being filled (container 16A, in FIG. 1).

As articles 18 are loaded into the container 16A, some or all of the articles impact the feeler arms extending over container 16A, causing the feeler arms 10 to be deflected downward. So long as the container is not filled with articles 18, the articles fall past the feeler arms 10, which are biased upward, and thus return to an undeflected position.

However, when the container 16A is full, as illustrated in FIG. 1, the feeler arms 10 extending over the container 16A become trapped between articles 18 in the container so that the feeler arms cannot return to an undeflected position. A sensor mechanism, described below, senses whether one or more of the feeler arms extending over container 16A is deflected (i.e., has not returned to an undeflected position). In particular, if the sensor mechanism detects that a feeler arm 10 has remained in a deflected position for a predetermined period of time, the full container recognition system supplies a signal indicating that the container 16A is full. The signal may, for example, be the illumination of a light 20, which is positioned at the top of post 6. Once container 16A is filled with articles 18, it is replaced with an empty container 16 to be filled with articles.

Figures 2, 4:
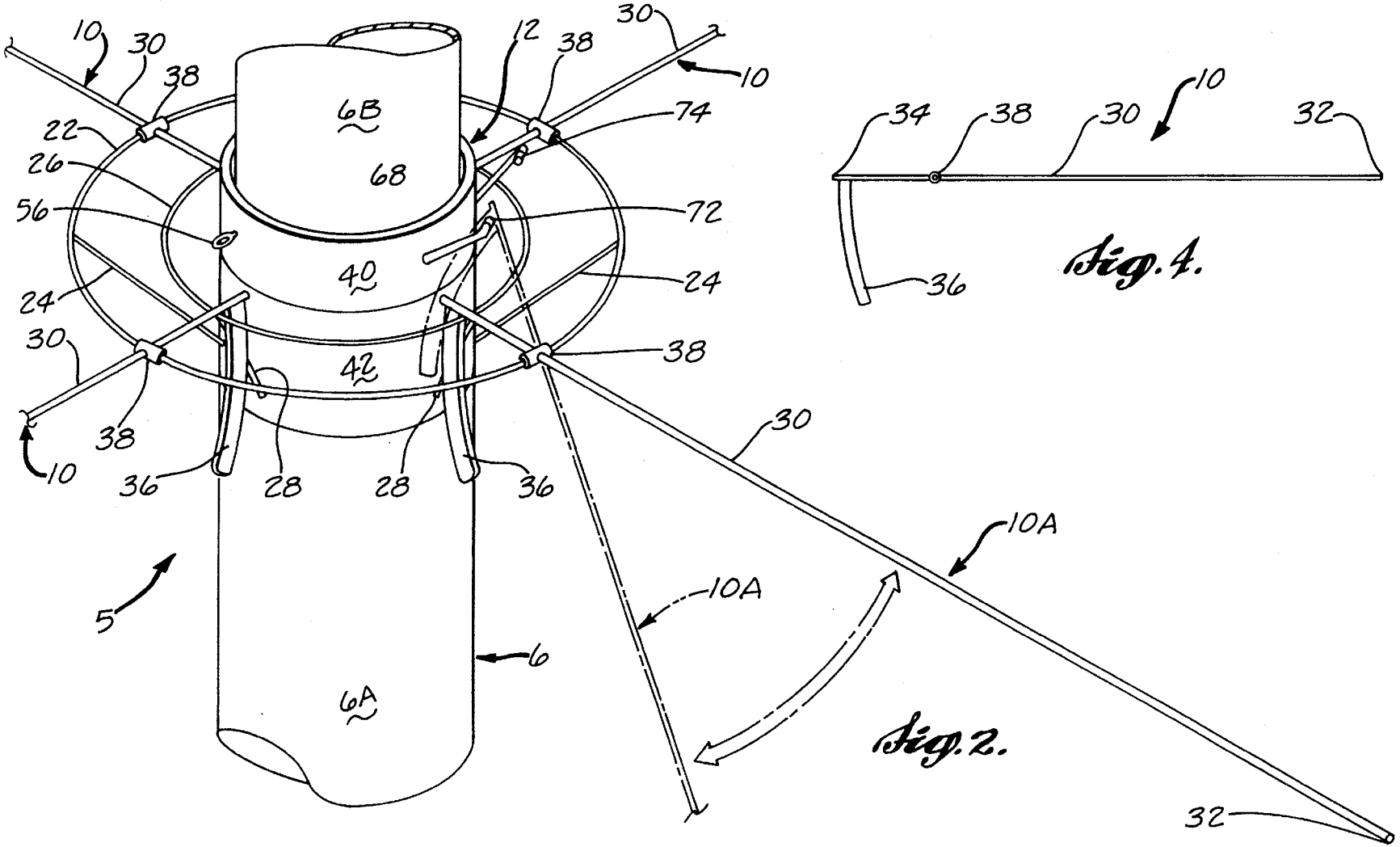
FIG. 2 is an enlarged view of a portion of the device of FIG. 1 that includes a collar assembly from which feeler arms circumferentially extend for detecting when a bag of FIG. 1 is filled.
FIG. 4 is an enlarged view of a feeler arm of the arrangement of FIG. 1.

FIG. 2 is an enlarged view of collar assembly 12, with only four of the feeler arms 10 being shown for clarity. As is indicated by the arrows and the phantom view of feeler arm 10A, the feeler arms are mounted to an outer support ring 22 for pivotable movement in the downward direction (i.e., downward deflection). Outer support ring 22 is circular in cross-section and is maintained in a radially spaced-apart orientation with pole 6 by four support struts 24, only two of which are shown in FIG. 2. The support struts 24 extend between four equally spaced-apart locations on outer support ring 22 and four equally spaced circumferential locations of the collar assembly 12. The ends of the struts 24, opposite the collar assembly 12, attach to the lower inner side of the outer support ring 22 at four evenly spaced circumferential locations.

Mounted concentrically between outer support ring 22 and post 6 is the inner stop ring 26. Inner stop ring 26 is supported by four support struts 28, of which only two are shown in FIG. 2. Support struts 28 are arranged on the same manner as support struts 24, extending between four equally spaced-apart locations on inner support ring 26, and four equally spaced, circumferential locations around the central hub region of the collar assembly 12.

An individual feeler arm 10 is shown in FIG. 4. Each feeler arm 10 includes a rod-like body portion 30, having an outer end 32 and an inner end 34. Located intermediate the inner and outer ends 32 and 34, but nearer the inner end 34, is a sleeve 38. Each sleeve 38 is cylindrical in cross-sectional geometry, with the longitudinal axis of each sleeve 38 having a radius of curvature that matches that of outer support ring 22. In addition, the diameter of the central opening of sleeve 38 is slightly larger than the diameter of the outer support ring 22. Thus, each sleeve 38 can be slid onto the outer support ring 22, thereby pivotably mounting each feeler arm 10 to the outer support ring. Preferably, the length of the sleeve 38 on each feeler arm 10 is dimensioned such that the ends of each sleeve abut one another when all of the feeler arms are mounted on the outer support ring 22. Thus, the sleeves 38 maintain the feeler arms 10 in a spaced-apart circumferential relationship with one another.

When the sleeve 38 of each feeler arm 10 is mounted on outer support ring 22, the feeler arms rest on the upper surface of the inner stop ring 26, with the feeler arm inner ends 34 being positioned between inner stop ring 26 and post 6. Thus, the outer end 32 of the feeler arm may be deflected downwardly, but upward deflection is precluded by the inner stop ring 26.

Mounted to the inner end 34 of each feeler arm 10 is a curved weight 36, which serves to downwardly bias the inner end 34 of each feeler arm 10 so that each feeler arm rests on the upper surface of inner stop ring 26. In the depicted arrangement, the weight 36 is curved to prevent the weight from striking other portions of the system 5 if the associated feeler arm 10 is deflected so that the weight 36 is swung upwardly about outer support ring 22.

Figure 3:
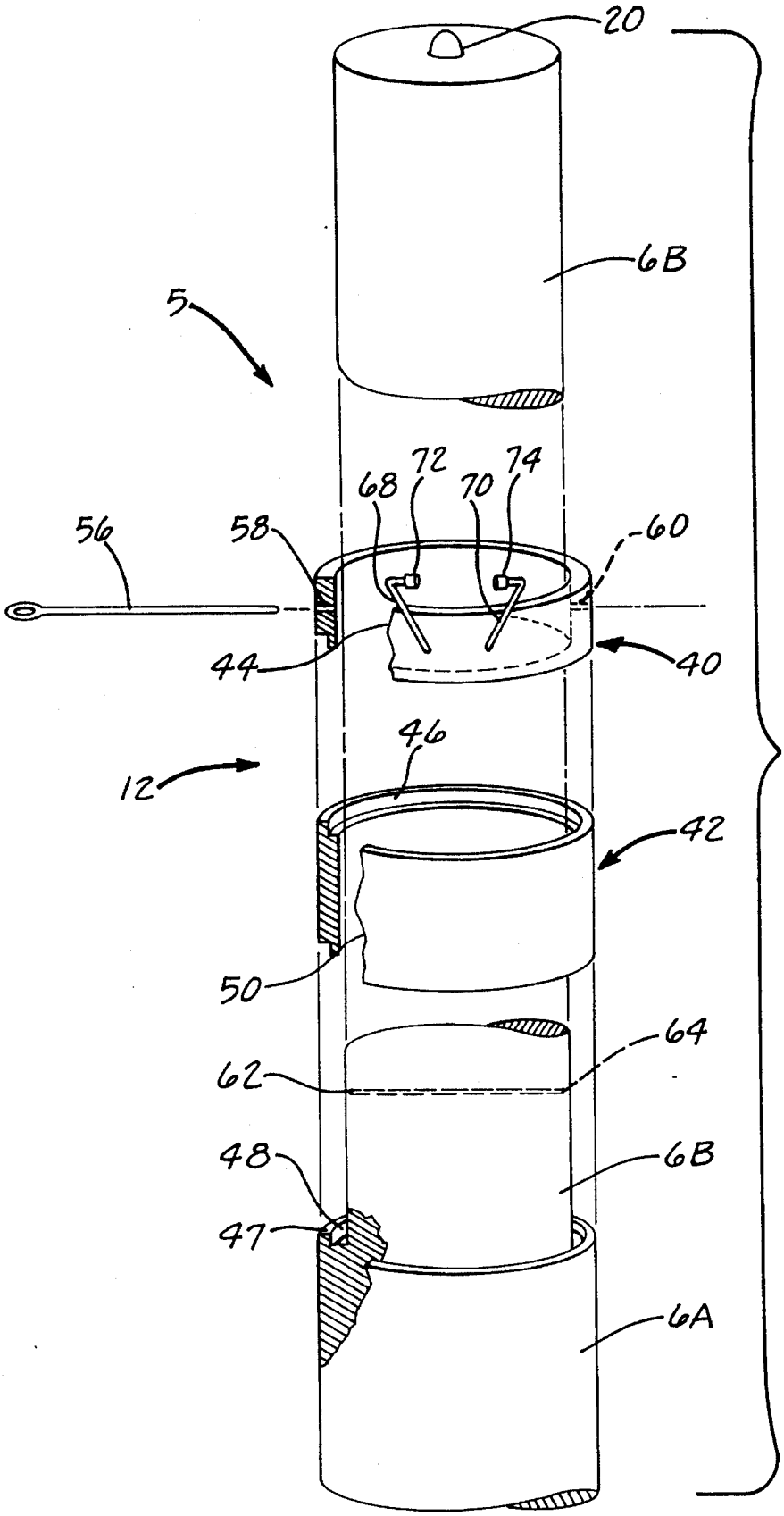
FIG. 3 is an exploded view of the collar assembly and a portion of the post shown in FIGS. 1 and 2.

As is shown in FIG. 3, the previously mentioned central hub region of collar assembly 12 includes a cylindrical upper collar half 40 and a cylindrical lower collar half 42. The lower half 40 supports the struts 24 and 28 ( FIG. 2), which, in turn, respectively support the outer support ring 22 and the inner stop ring 26. For clarity, however, the rings 22 and 26 and the struts 24 and 28 are not shown in FIG. 3.

Extending downwardly around the outer circumference of the bottom end of the upper collar assembly 40 is bearing flange 44. Formed around the inner circumference of the upper end of the lower collar assembly 42 is a complementary bearing flange 46. When the upper and collar halves 40 and 42 are assembled, bearing flange 44 is received by bearing flange 46, thus allowing the collar halves to rotate relative to one another.

As also is shown in FIG. 3, the post 6 is formed by an upper half 6B that is received by and extends from the central opening of a cylindrical lower half 6A. An upwardly opening channel 48 is formed between the lower pole half 6A and the lower terminus of upper pole half 6B. Specifically, a cylindrical flange 47 extends upward from the periphery of the lower half of post 6 to form channel 48 between the interior of the flange 47 and the upper half of post 6. Formed around the outer circumference at the bottom end of the lower collar half 42, is a cylindrical bearing flange 50 that is received by the channel 48 so that the lower collar half 42 can rotate about the post 6.

When both the lower collar half 42 and the upper collar half 40 over the upper post half 6B are installed on the post 6, a cotter pin 56 is inserted through a pair of diametrically opposed openings 58 and 60 in the upper collar half 40, and diametrically opposed apertures 62 and 64 formed in the upper post half 6B. Thus, in the currently preferred embodiments of the invention, the lower collar half 42 can rotate relative to the post 6 and the upper collar half 40, while the upper collar half remains stationary relative to the post. This arrangement prevents both the longitudinal (upward and downward) movement of the collar assembly 12 relative to the post 6 and the longitudinal movement of the collar halves 40 and 42 relative to each other. In addition, the openings 62 and 64 in the post 6 can be located so that at least some of the weight of the upper collar half 40 is borne by the cotter pin 56, and not just by the lower collar half 40. This arrangement permits freer rotation of the lower collar half 42 and reduced wear.

With continued reference to FIG. 3, extending outwardly and upwardly from the upper collar half 40 are a pair of sensor supports 68 and 70. As can be seen in both FIGS. 2 and 3, sensor supports 68 and 70 are rod-like in geometry and extend above the inner stop ring 26. Mounted to the end of strut 68 is source of illumination 72, which directs light toward sensor support 70. Mounted to the end of sensor support 70 is light sensor 74, which receives light emitted by illumination source 72. When the outer end 32 of a feeler arm 10 is deflected downwardly, the inner end 34 of the feeler arm moves upwardly so that the weight 36 attached to the feeler arm, travels upwardly between sensor supports 68 and 70 blocking the light that would otherwise be received by light sensor 74 (illustrated by the phantom position of feeler arm 10A in FIG. 2). When the light is blocked, the light sensor 74 supplies a signal, indicating that the outer end 32 of a feeler arm 10 has been rotated downwardly.

As seen on FIG. 1, when the light sensor 74 produces such a signal for a predetermined period of time (indicating that a feeler arm has not returned to the upwardly biased condition), a timer circuit 76 provides a signal that indicates that the container 16A is full. For example, light 20 is energized. The timer circuit 76 is of any standard type, well known in the art, and preferably incorporated into an integrated circuit. The timer circuit 76 can be mounted within the post 6 as illustrated in FIG. 1.

While preferably a light sensor 74 and illumination source 72 is used to determine when a feeler arm 10 has been deflected downwardly, other types of sensors can be used as well. For example, standard proximity sensors can be used, which detect a change in inductance or capacitance when an object, such as a feeler arm 10, comes into close proximity to the sensor.

Once the container 16A is full as shown in FIG. 1, the full container is removed from its position of radial alignment with the light sensor 74 and illumination source 72, and replaced with an empty container 16. Preferably, the body portion 30 of each feeler arm 10 is made of reasonably firm, resilient material such as plastic or metal, so that the feeler arms can sense when a container is full, but will flex and return to their original shape after being trapped against one or more articles 18.

While a preferred embodiment of the invention has been illustrated and described, it will be appreciated that various changes can be made therein while remaining within the scope of the invention. For example, the feeler arms 10 can be made from a variety of relatively rigid and resilient materials, including numerous metals and plastics. In some instances, the biasing force can be a spring, rather than a weight 36. Further, rather than the feeler arms 10 being rotatably mounted, the feeler arms can be rigidly attached in place, and be resiliently deflected downwardly between a suitable detector. Additionally, movement of the upper collar half 40 relative to the post 6 can be prevented by means other than the cotter pin 56 (e.g., screws, welding, nails, etc., can be used). Also, in some cases, the upper collar half 40 can be eliminated, with the light sensor 74 and illumination source 72 being mounted to a portion of the post 6 above the lower collar half 42. Further, proximity sensors can be used instead of the light sensor 74 and illumination source 72. Since changes can be made to the illustrated embodiments of the invention, the invention should be defined by reference to the claims.

The embodiments of the invention in which an exclusive property or privilege is claimed are defined as follows:

1. A full container recognition system for determining when a container, having an upwardly facing opening, is filled with articles to a predetermined level, the full container recognition system comprising:

(a) at least one elongate feeler arm, each said feeler arm having an inner end and an outer end;

(b) support means for supporting said at least one feeler arm in an up position in which the outer end thereof extends over the opening of the container to be filled;

(c) means for biasing said at least one feeler arm in said up position, said biasing means allowing downward movement of said outer end of said feeler arm when said feeler arm is impacted by an article that is traveling downwardly into the opening of the container, said biasing means causing said feeler arm to return to said up position when the article passes downwardly beyond said outer end of said feeler arm; and (d) detection means for supplying a signal indicating that said at least one feeler arm has been deflected downwardly, but has not returned to said up position within a predetermined period of time, said signal indicating that the container is filled to the predetermined level.

2. The full container recognition system of claim 1 wherein said at least one feeler arm is rotatably mounted to said support means and said bias means includes means for urging said inner end of each said feeler arm downwardly so that said at least one feeler arm is in said up position.

3. The full container recognition system of claim 2 wherein said at least one feeler arm is a plurality of substantially identical feeler arms that extend from said support means and are circumferentially spaced apart from one another.

4. The full container recognition system of claim 3 wherein said support means includes an outer support ring of substantially circular cross-sectional geometry, and wherein each said feeler arm includes a cylindrical sleeve coaxially surrounding said outer support ring to rotatably mount each said feeler arm to said outer support ring.

5. The full container recognition system of claim 4 wherein the outer support ring is rotatable about its central axis.

6. The full container recognition system of claim 2, further comprising a stop spaced-apart from said support means positioned so that the inner end of said at least one feeler arm abuts the stop when said at least one feeler arm is in the up position, thereby preventing further upward rotation of said at least one feeler arm.

7. The full container recognition system of claim 6 wherein said at least one feeler arm is a plurality of substantially identical feeler arms that extend from said support means and are circumferentially spaced apart from one another, and said stop is an inner stop ring positioned so that the inner end of each feeler arm abuts the inner stop ring when the feeler arm is in the up position, thereby preventing further upward rotation of the feeler arm.

8. The full container recognition system of claim 6 wherein said means for urging each said feeler arm downwardly includes a weight attached to the inner end of each said feeler arm to bias the inner end each said feeler arm in abutment with said stop.

9. The full container recognition system of claim 1 wherein the detection means includes an illumination source and a light detector, said illumination source emitting light that is received by the light detector, said light detector supplying a signal indicating whether it is receiving said light; and wherein at least one feeler arm is positioned to interrupt light passing from said illumination source to said light detector when the feeler arm is deflected downward from the up position to cause said light detector to supply said signal while said light from said illumination source is interrupted.

10. A full container recognition system for determining when a container having an upwardly facing opening for loading articles into the container is filled to a predetermined level, comprising:

(a) an outer support ring; and (b) a plurality of substantially identical feeler arms, each having inner and outer ends, the feeler arms being rotatably mounted in spaced-apart relationship with one another about the circumference of the outer support ring, the feeler arms being rotatable downwardly about the outer support ring from a first position in which the outer end of at least one feeler arm extends above the opening in the container; and (c) means for urging each feeler arm to return to the first position when that feeler arm is impacted and deflected downwardly by an article that is traveling downwardly into the opening of the container, the article causing the arm to rotate downwardly from the first position and the urging means causing a deflected feeler arm to return to the first position when the article passes downwardly beyond the outer end of said deflected feeler arm, the urging means allowing said deflected feeler arm to remain rotated downwardly when the article does not pass downwardly beyond the outer end of said deflected feeler arm.

11. The full container recognition system of claim 10 wherein the urging means comprises a weight attached to the inner end of each feeler arm.

12. The full container recognition system of claim 10 further comprising an inner stop ring, concentric within the outer support ring, the inner end of each feeler arm abutting the inner stop ring when the feeler arm is in the first position to prevent further upward rotation of the feeler arm.

13. The full container recognition system of claim 10 further comprising a sensor to detect when a feeler arm is rotated downwardly from the first position.

14. The full container recognition system of claim 13 further comprising a timer to determine if the feeler arm has been rotated downwardly for a period of time greater than a predetermined period of time.

15. The full container recognition system of claim 13 wherein the sensor includes an illumination source for emitting light and a light detector for supplying a signal indicating when said light detector is and is not receiving light from said illumination source; and wherein at least one of the feeler arms blocks the light emitted by the illumination source from being received by the light detector when the feeler arm is rotated downwardly, thereby causing the light detector to supply a signal indicating deflection of the feeler arm.

16. The full container recognition system of claim 13 wherein the outer support ring is rotatable about its central axis and wherein the sensor is stationary relative to the central axis of the outer support ring.

17. A method for determining when a container, having a generally upwardly facing opening, is filled with articles to a predetermined level, comprising the steps of:

(a) positioning a feeler arm having an outer end in a position in which the outer end of the feeler arm extends over the opening in a first position;

(b) repeatedly loading articles into the container along a path that causes the articles to contact the outer end of the feeler arm and deflect the feeler arm downwardly as the articles enter into the container;

(c) biasing the feeler arm to return to the first position after being deflected downwardly by an article that passes downwardly beyond the feeler arm;

(d) detecting when the feeler arm remains downwardly deflected from the first position for a period of time greater than a predetermined period, thereby indicating that the container is filled to approximately the predetermined level; and (e) ceasing to load articles into the container when the feeler arm has remained deflected downwardly from the first position for a period of time greater than the predetermined period.

18. The method of claim 17 wherein the step of positioning the feeler arm includes the substeps of:

(a) rotatably mounting the feeler arm to an axle, with the feeler arm rotatable to the first position and to a down position; and (b) positioning the axle with the outer end of the feeler arm extending over the opening with the feeler arm being in the first position.

19. The method of claim 17 wherein the feeler arm has an inner end opposite the outer end, and the step of biasing the feeler arm includes the substep of attaching a weight to the inner end of the feeler arm.

20. The method of claim 17, wherein the step of detecting when the feeler arm remains downwardly deflected includes the substeps of:

(a) positioning an illumination source and a light detector so that the illumination source emits light that is received by the light detector and so that light traveling from the illumination source to the light detector is interrupted when a feeler arm is rotated downwardly, thereby causing the light detector to supply a signal; and (b) supplying the signal from the light detector to a timer to determine the period of time that the feeler arm remains downwardly deflected from the first position.

* * * * *

UNITED STATES PATENT AND TRADEMARK OFFICE

CERTIFICATE OF CORRECTION

PATENT NO. : 5,473,312

DATED : December 5, 1995

INVENTOR(S) : L. Duran

It is certified that error appears in the above-indentified patent and that said Letters Patent is hereby corrected as shown below:

| COLUMN | LINE | |
|---|---|---|
| Pg. 1, col. 2 | Atty., Agt., or Firm | "O'Connor Johnson" should read --O'Connor, Johnson-- |
| 3 | 11 | "traps" should read --straps-- |
| 7 (Claim 10, | 29 line 18) | Before "arm" insert --feeler-- |

Signed and Sealed this

Ninth Day of April, 1996

Bruce Lehman

*Attest:*

BRUCE LEHMAN

*Attesting Officer*

*Commissioner of Patents and Trademarks*